US006190195B1

(12) United States Patent
Yamamoto et al.

(10) Patent No.: US 6,190,195 B1
(45) Date of Patent: Feb. 20, 2001

(54) ELECTRICAL CONNECTOR HAVING TERMINAL DISTORTION PREVENTING STRUCTURE

(75) Inventors: Hiroshi Yamamoto; Masahiro Kanda, both of Shizuoka (JP)

(73) Assignee: Yazaki Corporation, Tokyo (JP)

( * ) Notice: Under 35 U.S.C. 154(b), the term of this patent shall be extended for 0 days.

(21) Appl. No.: 09/226,189

(22) Filed: Jan. 7, 1999

(30) Foreign Application Priority Data

Jan. 9, 1998 (JP) ..... 10-003281

(51) Int. Cl.[7] ..... H01R 13/64
(52) U.S. Cl. ..... 439/381; 439/682; 439/374
(58) Field of Search ..... 439/374, 381, 439/851, 862, 842, 845, 850, 595, 597, 603

(56) References Cited

U.S. PATENT DOCUMENTS

| | | | | |
|---|---|---|---|---|
| 4,067,633 | | 1/1978 | Groft et al. | 339/74 |
| 5,360,356 | * | 11/1994 | May et al. | 439/839 |
| 5,890,932 | * | 4/1999 | Muta | 439/682 |

FOREIGN PATENT DOCUMENTS

| | | |
|---|---|---|
| 34 18 249 A1 | 11/1985 | (DE) . |
| 0 005 370 A1 | 11/1979 | (EP) . |
| 61-117470 | 7/1986 | (JP) . |
| 5-53146 | 7/1993 | (JP) . |
| 9-45401 | 2/1997 | (JP) . |

* cited by examiner

*Primary Examiner*—Paula Bradley
*Assistant Examiner*—Alexander Gilman
(74) *Attorney, Agent, or Firm*—Armstrong, Westerman, Hattori, McLeland & Naughton

(57) ABSTRACT

The connector includes at least a terminal accommodating cavity for receiving a receptacle terminal of a rectangular hollow beam. The receptacle terminal has an electrical connection portion including a resilient contact tongue. The terminal accommodating cavity has a pin terminal insertion opening. Furthermore, a distortion preventing member extending from said pin terminal insertion opening is provided in the terminal accommodating cavity. The distortion preventing member is constructed to prevent distortion of a pin terminal even when the pin terminal is incorrectly inserted in a slanting direction through the pin terminal insertion opening into the receptacle terminal. The distortion preventing member has a rising wall rising from a bottom wall of the terminal accommodating cavity. An extended wall is provided to extend from a free end of the rising wall into the terminal accommodating cavity. The extended wall may have a slit positioned in a middle portion thereof, the slit extending in the insertion direction of the pin terminal.

7 Claims, 6 Drawing Sheets

ELECTRICAL CONNECTOR HAVING TERMINAL DISTORTION PREVENTING STRUCTURE

BACKGROUND OF THE INVENTION

1. Field of the Invention

The present invention relates to an electrical connector, more particularly to a connector having a distortion preventing structure for preventing deformation of both a pin terminal and a resilient contact tongue provided in the connector and for correcting the insertion direction of the pin terminal when the pin terminal is inserted into the receptacle terminal to make contact with the resilient contact tongue.

2. Prior Art

There has been proposed a receptacle terminal having a distortion preventing structure in Japanese Utility Model Application Laid-open No. 61-117,470, which is shown in FIG. 8. The distortion preventing structure includes a protection/guide piece 62 and a resilient pinching inner strip 63 (FIG. 9). The guide piece 62 is formed continuously from a fore end portion of a rectangular hollow beam shaped electrical connection portion 61 that defines the receptacle terminal.

The receptacle terminal 60 is received in a connector housing 64, and a pin terminal 65 is received in an opposed connector housing (not shown), which defines a connector 66 and an associated opposed connector (not shown). Engagement of the connector 66 with the associated connector connects electrically the resilient strip 63 of the receptacle terminal 60 to the pin terminal 65. Even when the associated connector is opposed to the connector 66 incorrectly in a slating direction during their mating, the guide piece 62 of the receptacle terminal 60 can correct the insertion direction of the pin terminal 65.

However, the receptacle terminal 60 has a complicated configuration, which requires an increased manufacturing cost. Furthermore, a smaller receptacle terminal 60 provides a thinner guide piece 62 that is reduced in strength. The pin terminal 65 may deform the thinner guide piece 62 when the connector 66 is engaged with the associated connector incorrectly in a slanting direction so that the pin terminal 65 is forcedly inserted into the receptacle terminal 60. This possibly causes the pin terminal 65 to abut against the resilient pinching strip 63 to undesirably distort (or deform) the resilient pinching strip 63.

Furthermore, there has been also proposed another receptacle terminal having a distortion preventing structure in Japanese Utility Model Application Laid-open No. H. 5-53, 146, which is shown in FIG. 10.

The distortion preventing structure includes a pair of extending tabs 72 and an inner resilient contact tongue 73 (see FIG. 11). Each extending tab 72 is formed continuously from a fore end portion of an electrical connection portion 71 that composes a receptacle terminal 70. The extending tab 72 covers a lower half of the fore end opening of the receptacle terminal 70. Engagement of a connector 74 accommodating the receptacle terminal 70 with an opposed associated connector (not shown) connects electrically the resilient contact tongue 73 of the receptacle terminal 70 to a pin terminal 75.

Even when the associated connector is opposed to the connector 74 incorrectly in a slanting direction during their mating, the extending tabs 72 of the receptacle terminal 70 can correct the insertion direction of the pin terminal 75.

However, the extending tabs 72 can correct the insertion direction of the pin terminal 75 that has been inserted into the receptacle terminal 70 in a slanting direction only when the slanting angle is within a small range. That is, the correctable initial insertion angle of the pin terminal 75 is limited in a small range because the extending tab 72 has a small thickness s that is usually the same as that of the receptacle terminal 70.

SUMMARY OF THE INVENTION

In view of the above-mentioned disadvantage, an object of the present invention is to provide a connector having a terminal distortion preventing structure for preventing deformation of both a pin terminal and a resilient contact tongue provided in a receptacle terminal of a connector even when the pin terminal is inserted into the receptacle terminal incorrectly in a slanting direction of which the slanting angle can be within a larger range.

To achieve the object, a connector according to a first basic configuration of the present invention includes:

at least a terminal accommodating cavity for receiving a receptacle terminal of a rectangular hollow beam, the receptacle terminal having an electrical connection portion including a resilient contact tongue, the terminal accommodating cavity having a pin terminal insertion opening, and a distortion preventing member extending from said pin terminal insertion opening in said terminal accommodating cavity. The distortion preventing member is defined to prevent distortion of a pin terminal even when the pin terminal is incorrectly inserted in a slanting direction through the pin terminal insertion opening into the receptacle terminal. According to a second additional configuration of the present invention, the distortion preventing member has a rising wall rising from a bottom wall of the terminal accommodating cavity, the rising wall opposed to the resilient contact tongue, and an extended wall extending from a free end of the rising wall into the terminal accommodating cavity, the extended wall being in no interference relation with the resilient contact tongue, whereby the pin terminal is corrected in its insertion direction by the extended wall and an inner surface of the pin terminal insertion opening when the pin terminal is inserted incorrectly in a slanting direction into said receptacle terminal.

According to a third additional configuration of the present invention, the extended wall is substantially the same as the pin terminal in lateral width, According to a fourth additional configuration of the present invention, the extended wall has a slit positioned in a middle portion thereof. The slit extends in the insertion direction of the pin terminal.

Operation and effects of the present invention will be discussed hereinafter.

As described above, in the first configuration of the invention, since the distortion preventing member is arranged adjacent to the pin terminal insertion opening of the terminal accommodating cavity, the pin terminal abuts slidably against the distortion preventing member even when the pin terminal is incorrectly inserted in a slanting direction through the pin terminal insertion opening into the receptacle terminal. This prevents distortion (or deformation) of the pin terminal. Thus, the pin terminal having no undesirable distortion can make an electrical connection with the receptacle terminal, improving the connection in reliability.

In the second configuration of the invention, the distortion preventing member have the rising wall rising from the bottom wall of the terminal accommodating cavity and the extended wall extending from a free end of the rising wall into the terminal accommodating cavity, the extended wall being spaced from the resilient contact tongue in no interference relationship. Thereby, the pin terminal abuts sidably against both the extended wall and the inner surface of the pin terminal insertion opening when the pin terminal is inserted incorrectly in a slanting direction, so that the pin terminal does not forcedly abut against the resilient contact tongue. Then, the pin terminal is corrected gradually in its direction by both the extended wall and the inner surface of the pin terminal insertion opening, allowing a smooth connection of the pin terminal with the resilient contact tongue of the receptacle terminal.

In the third configuration of the invention, since the extended wall is substantially the same as the pin terminal in lateral width, the pin terminal is prevented more surely from distortion and is corrected in its insertion direction. In addition, the extended wall may have a larger width than that of the pin terminal.

In the fourth configuration of the invention, the extended wall has the slit positioned in a middle portion thereof and extending in the insertion direction of the pin terminal. This provides a smaller contact area of the pin terminal with the extended wall, allowing a more smooth insertion of the pin terminal.

DETAILED DESCRIPTION OF PREFERRED EMBODIMENTS

Referring to the accompanied drawings, an embodiment of the present invention will be discussed hereinafter.

FIGS. 1 to 7 show an embodiment of a connector having terminal distortion preventing structure.

Figure 1:
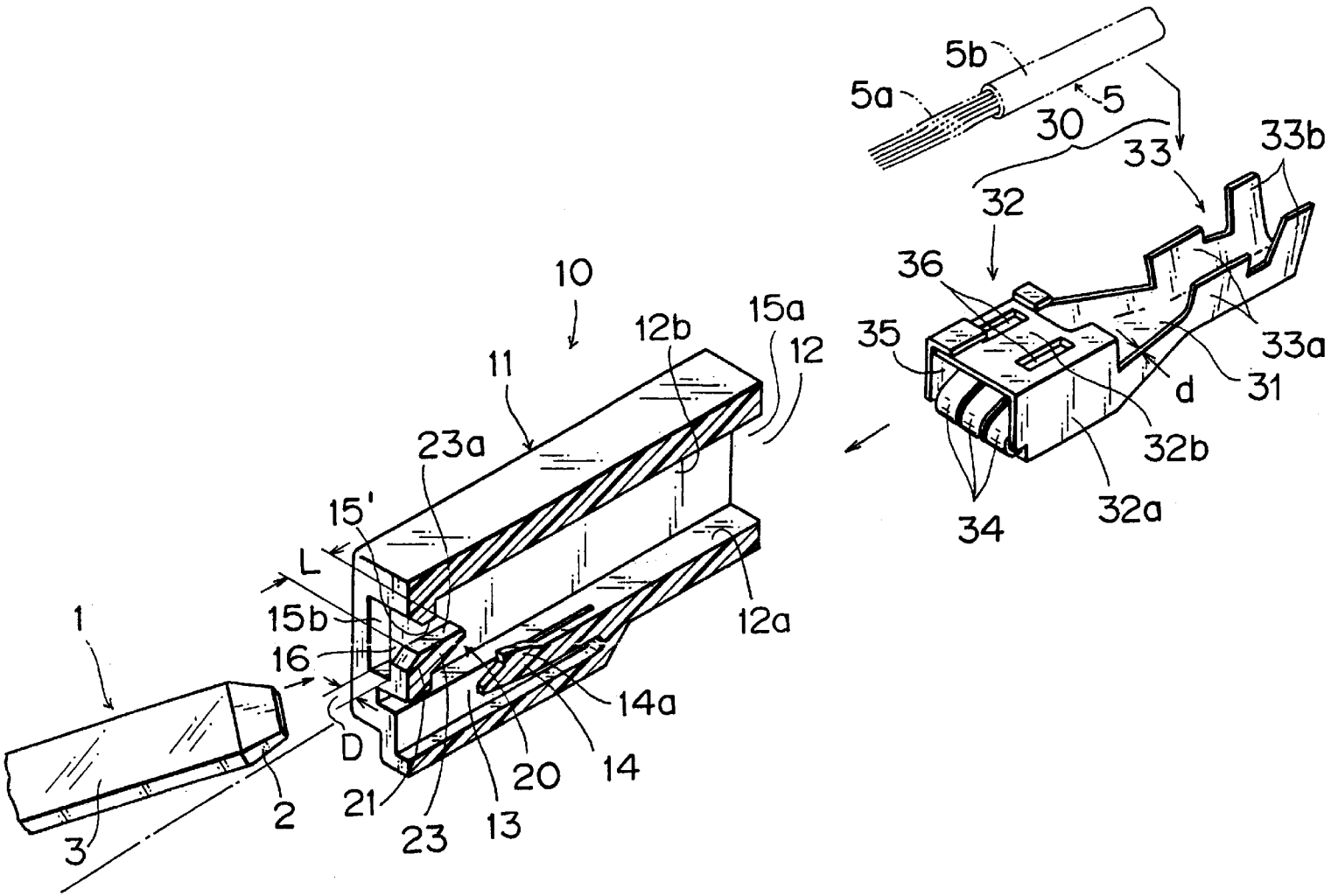
FIG. 1 is a perspective overview showing an embodiment of a connector having a terminal distortion preventing structure according to the present invention, in which a connector housing is shown in a sectional view taken along line Y—Y of FIG. 2.

As shown in FIG. 1, the connector has a connector housing 10, in which a terminal accommodating cavity 12 includes a distortion preventing member 20 for preventing distortion of a pin terminal 1 when it is inserted therein.

The connector housing 10 has a housing body 11 that defines the terminal accommodating cavity 12 for receiving a receptacle terminal 30. The terminal accommodating cavity 12 has a bottom wall 12*a* in which a recess 13 is formed. The housing body 11 has also a resilient lock arm 14 delectable in the recess 13. The terminal accommodating cavity 12 has an insertion opening 15*a* at the rear end thereof for inserting the receptacle terminal 30 and also a pin terminal insertion opening 15*b* at the fore end thereof for inserting the pin terminal 1. The resilient lock arm 14 has a free end portion formed with a lock protrusion 14*a*. The receptacle terminal 30 is inserted into the terminal accommodating cavity 12 so that the bottom wall 12*a* of the terminal accommodating cavity 12 is opposed to a resilient contact tongue 34 of the receptacle terminal 30.

The terminal 1 is a pin terminal mounted in a second connector housing (not shown), or a tab-shaped terminal applied in a busbar (not shown) arranged in an electrical junction box (not shown).

The receptacle terminal 30 has a rectangular hollow beam shaped electrical connection portion 32 at one end side of a base plate 31 thereof and an electrical cable connection portion 33 at the other end side of the base plate 31. The electrical connection portion 32 has a pair of side walls 32*a*, 32*a* each rising from each side end of the base plate 31, a top wall 32*b* across the pair of side walls 32*a*, 32*a*, and the resilient contact tongue 34 extending from a fore end portion of the base plate 31 within the electrical connection portion 33. The base plate 31 has a lock hole 31*c* (FIG. 4) for locking the resilient contact tongue 34.

The electrical cable connection portion 33 has a pair of electrical wire crimping pieces 33*a* for crimping a wire core 5*a* of an electrical cable 5 and a pair of insulated cable crimping pieces 33*b* for crimping an insulated part 5*b* of the cable 5. Electrical connection of the pin terminal 1 to the receptacle terminal 30 will be made when the pin terminal 1 is inserted into the electrical connection portion 32 to make contact with the resilient contact tongue 34. In addition, denoted 36 is a raised contact that is formed by pushing out inwardly a portion of the top wall 32*b*.

Figure 2:
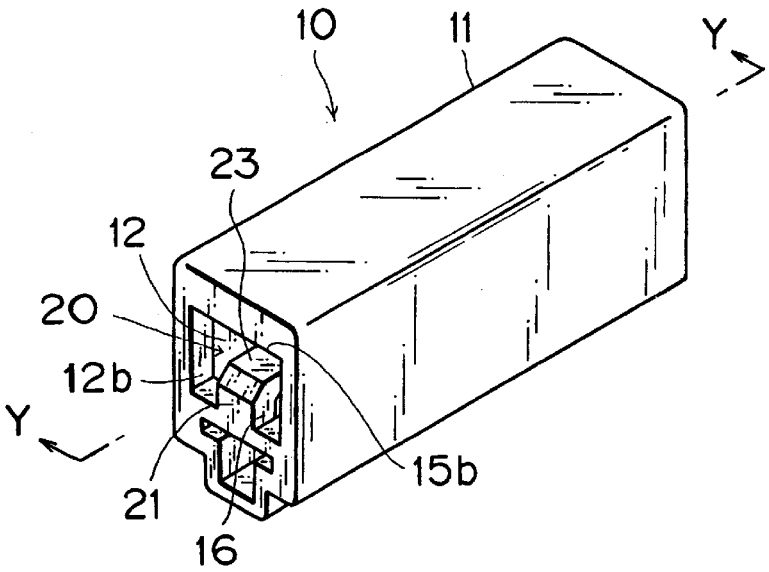
FIG. 2 is a perspective view of the connector housing of FIG. 1.
Figure 3:
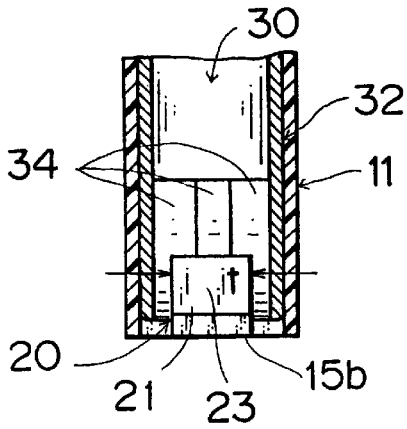
FIG. 3 is a cross-sectional view showing the connector housing of FIG. 2, which has received a receptacle terminal.
Figure 3:
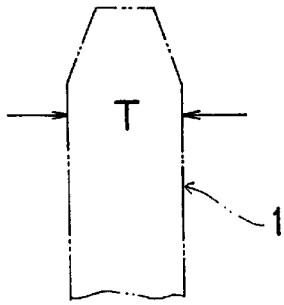

As shown in FIGS. 1 to 3, the distortion preventing member 20 comprises a rising wall 21 rising from the bottom wall 12*a* of the terminal accommodating cavity 12 and an extended wall 23 extending from a free end of the rising wall 21 into the terminal accommodating cavity 12. The rising wall 21 is positioned in the side of the pin terminal insertion opening 15*b*. The extended wall 23 is extending from the rising wall 21 in such a way that the extended wall 23 does not interfere with the resilient contact tongue 34 of the receptacle terminal 30 mounted in the terminal accommodating cavity 12. There is a clearance 16 between the extended wall 23 and each side wall 12*b* of the terminal accommodating cavity 12. Since the terminal accommodating cavity 12 receives the receptacle terminal 30, the width D of each clearance 16 may be only a little larger than the plate thickness d of the receptacle terminal 30 (see FIG. 1). Preferably, the width t of the extended wall 23 is substantially the same as the width T of the pin terminal 1.

Figure 5:
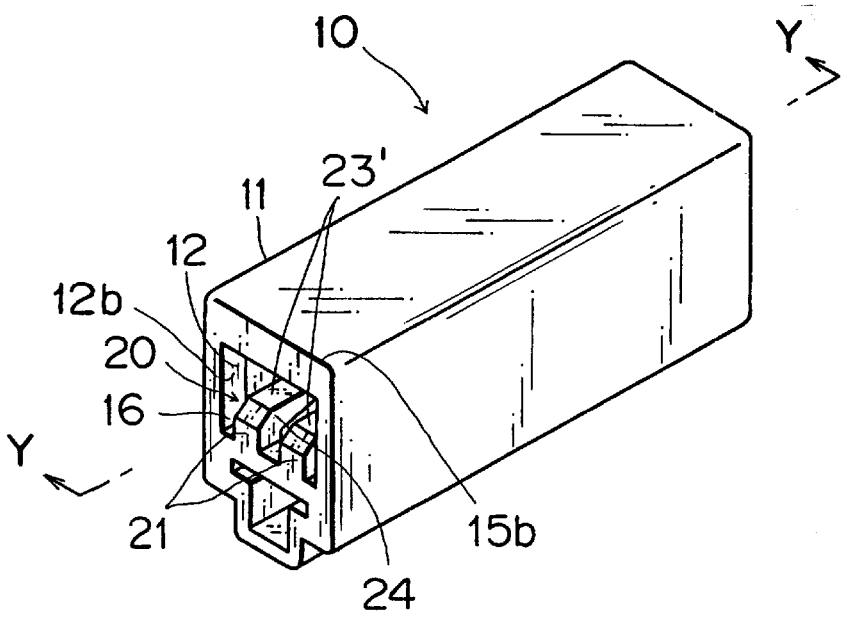
FIG. 5 is a perspective view showing the connector housing having a modified distortion preventing member.
Figure 6:
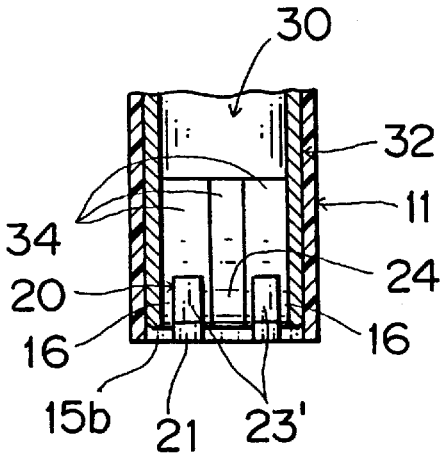
FIG. 6 is a cross-sectional view showing the connector housing that has received the receptacle terminal.

Furthermore, as shown in FIGS. 5 and 6, there is preferably provided a slit 24 extending in the pin terminal insertion direction in a middle portion of the extended wall 23. The extended wall 23' having the slit 24 reduces the contact surface of the leading end portion 2 of the pin terminal 1 with the extended wall 23', even when the pin terminal 1 is inserted incorrectly in a slanting direction into the pin terminal insertion opening to slide on the extended wall 23'. Thus, the pin terminal 1 can be inserted more smoothly into the electrical connection portion 32 due to a reduced friction of the pin terminal 1 on the extended wall 23'. Alternatively, for example, in place of the clearance 16, there may be provided a slit (not shown) formed in each side wall 32*a* of the electrical connection portion 32 of the receptacle terminal 30. Preferably, the top surface 23*a* of the extended wall 23 is flat.

Next, an insertion step of the pin terminal 1 into the receptacle terminal 30 that has received the receptacle terminal 30 in the terminal accommodating cavity 12 will be discussed hereinafter.

Figure 4:
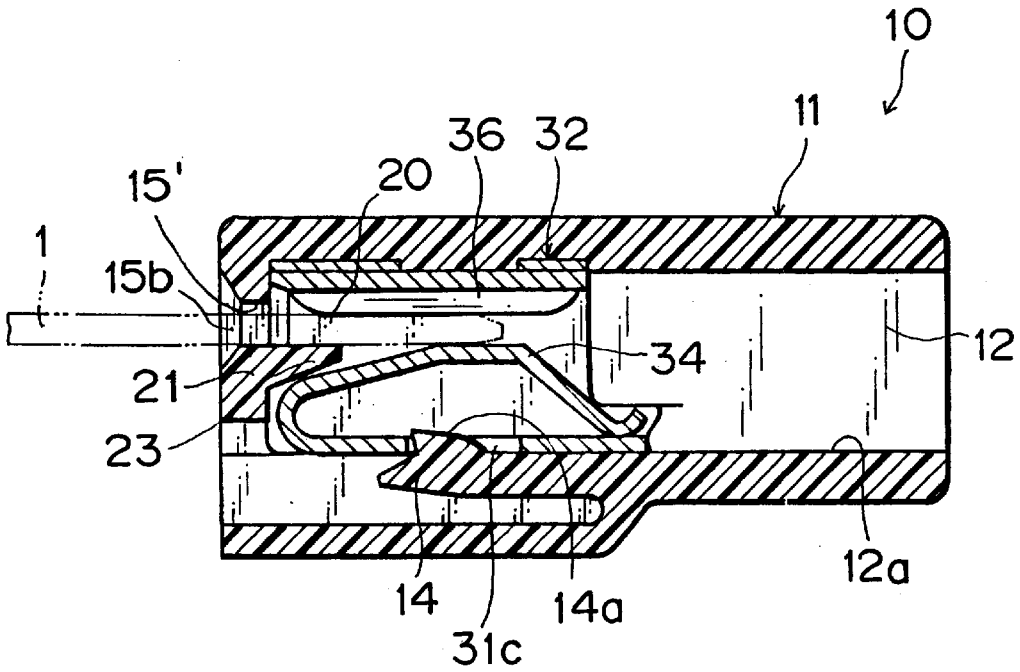
FIG. 4 is a longitudinal sectional view showing the connector housing which has received the receptacle terminal.

As shown in FIG. 4, the receptacle terminal 30 has been inserted from the insertion opening 15*a* into the terminal accommodating cavity 12 of the connector housing 10 so that the lock hole 31*c* formed in the base plate 31 of the receptacle terminal 30 engages with the lock protrusion 14*a* of the resilient lock arm 14. Thus, the receptacle terminal 30 has been locked in the terminal accommodating cavity 12. Furthermore, the extended wall 23 of the distortion preventing member 20 is partially received in the electrical connection portion 32 of the receptacle terminal 30 through the opening 35. However, the extended wall 23 is arranged not to make contact with the resilient contact tongue 34.

Figure 7:
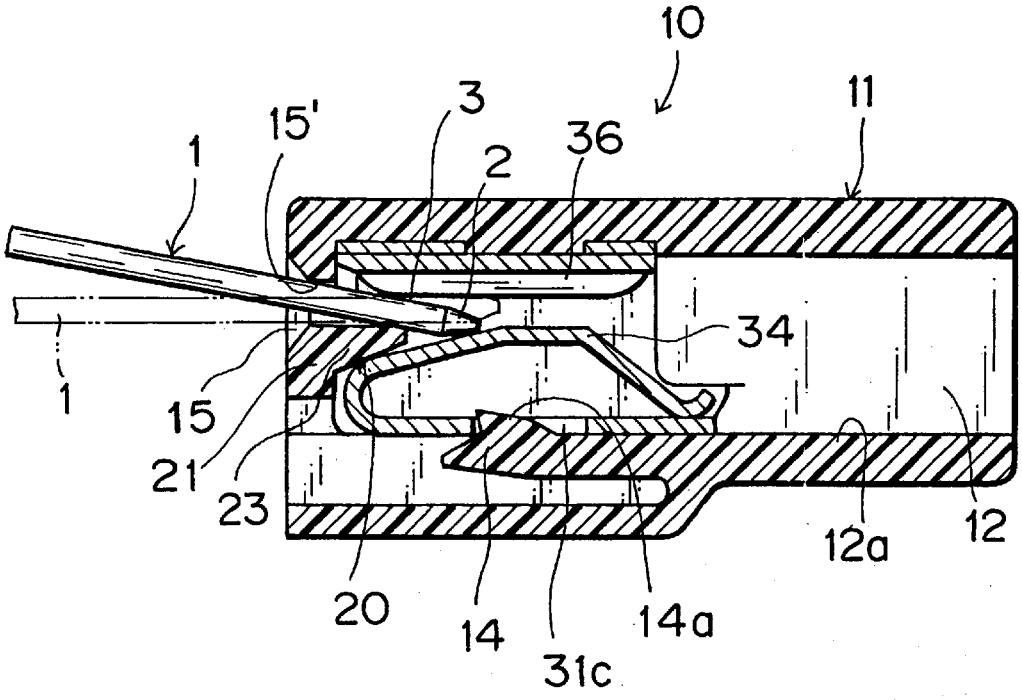
FIG. 7 is an explanatory longitudinal sectional view showing the connector housing that has received the receptacle terminal in its terminal accommodating cavity, in which a pin terminal is inserted initially incorrectly in a slanting direction.
Figure 8:
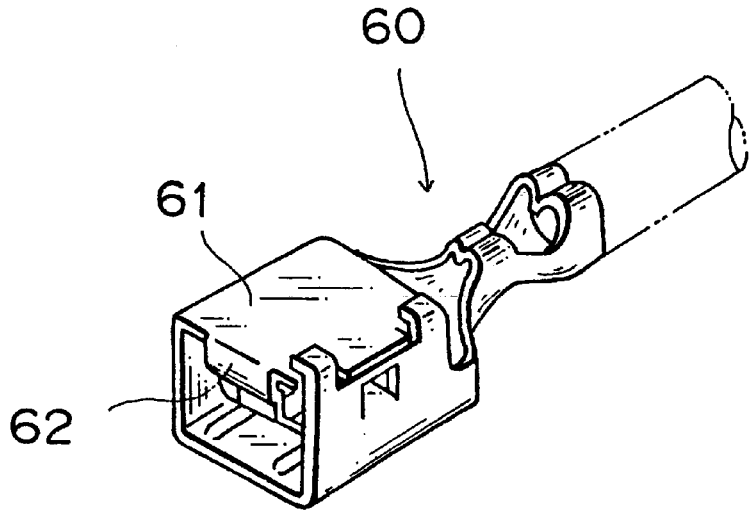
FIG. 8 PRIOR ART
FIG. 8 is a perspective view showing a conventional receptacle terminal.
Figure 9:
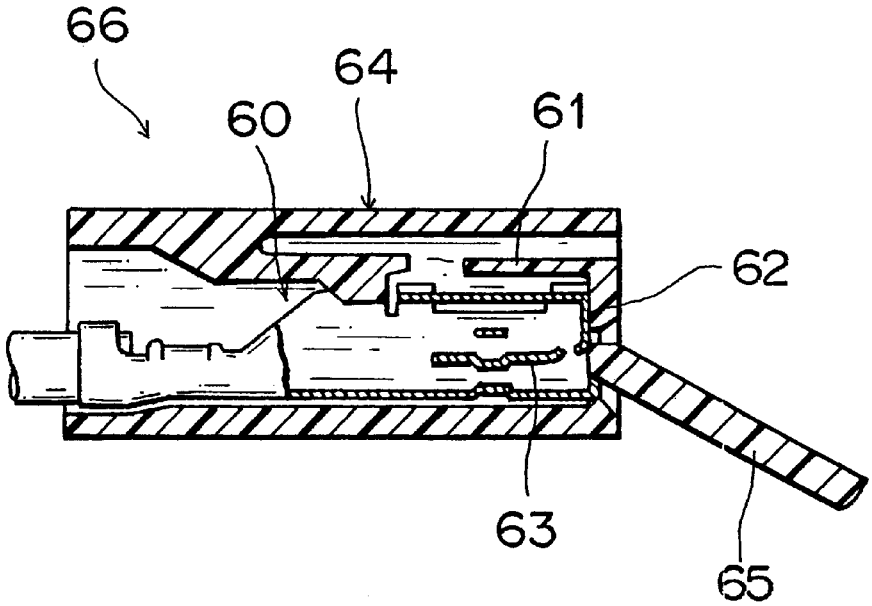
FIG. 9 PRIOR ART
FIG. 9 is an explanatory longitudinal sectional view showing a connector housing that has received the conventional receptacle terminal of FIG. 8, in which a pin terminal is inserted initially incorrectly in a slanting direction.
Figure 10:
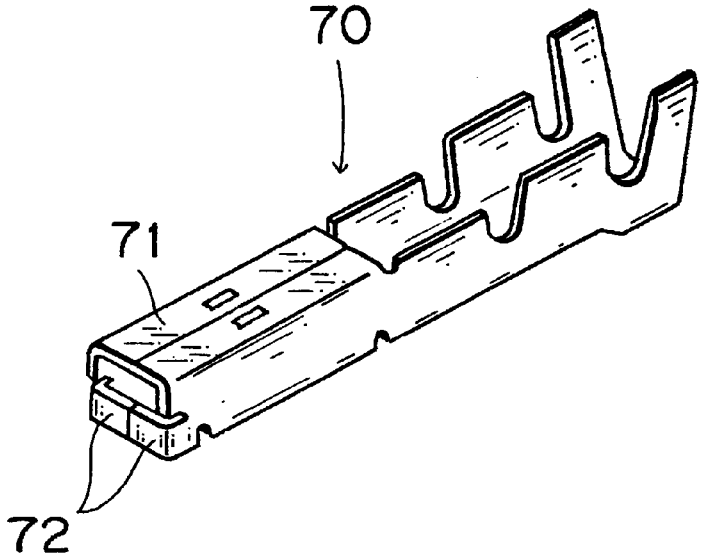
FIG. 10 PRIOR ART
FIG. 10 is a perspective view showing another conventional receptacle terminal.
Figure 11:
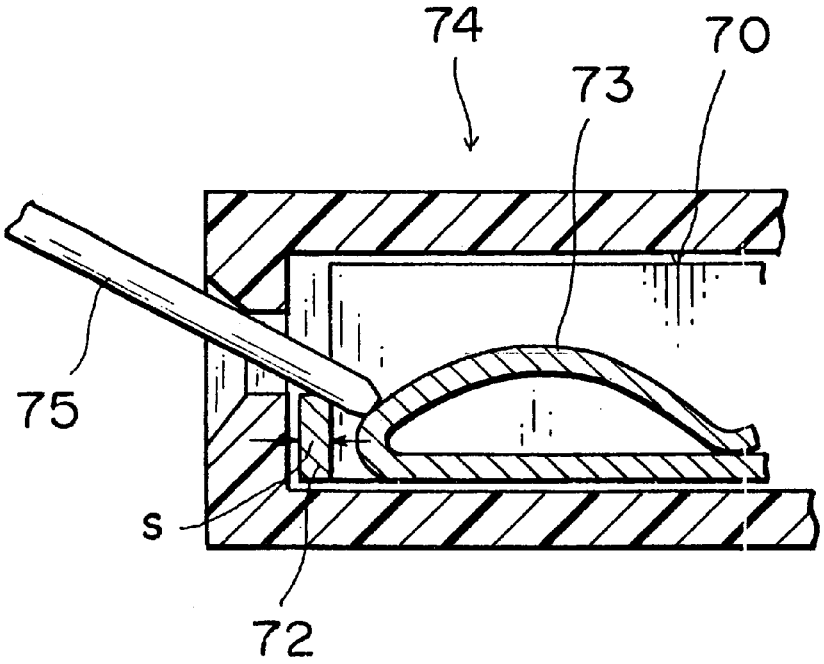
FIG. 11 PRIOR ART
FIG. 11 is an explanatory longitudinal sectional view showing a connector housing that has received the another conventional receptacle terminal of FIG. 10, in which a pin terminal is inserted initially incorrectly in a slanting direction.

As shown in FIG. 7, the pin terminal 1 is inserted from the pin terminal insertion opening 15*b* into the terminal accommodating cavity 12. When the pin terminal 1 is inserted from the pin terminal insertion opening 15*b* incorrectly in a slating direction, the leading end 2 of the pin terminal 1 abuts against the extended wall 23 of the distortion preventing member 20, thereby preventing an undesirable deformation of the pin terminal 1. When the pin terminal 1 which has been directed in the slanting direction is further pushed forcedly into the terminal accommodating cavity 12, a middle portion 3 of the pin terminal 1 abuts against the inner surface 15' of the pin terminal insertion opening 15*b*, and at the same time, the leading end 2 of the pin terminal 1 abuts against the extended wall 23 of the distortion preventing member 20.

However, the middle portion 3 of the pin terminal 1 slides on an inner surface 15' of the terminal accommodating cavity 12, and also the leading end 2 of the pin terminal 1 slides on the extended wall 23. Thus, the pin terminal 1 becomes gradually substantially in parallel with the receptacle terminal 30 from the slanting position. With the direction correction of the pin terminal 1, the pin terminal 1 advances further into the electrical connection portion 32 until the resilient contact tongue 34 of the receptacle terminal 30 makes electrical connection with the middle portion 3 of the pin terminal 1.

Thus, both the inner surface 15' of the terminal insertion opening 15*b* and the extended wall 23 of the distortion preventing member 20 can correct the insertion direction of the pin terminal 1 which is coming into the pin terminal insertion opening 15*b* in an undesired slanting direction. This allows the pin terminal 1 to smoothly make contact with the resilient contact tongue 34 of the receptacle terminal 30. Moreover, the pin terminal 1 does not push forcibly the resilient contact tongue 34, preventing deformation or breakage of the resilient contact tongue 34. Hence, this provides a more reliable electrical connection between the pin terminal 1 and the receptacle terminal 30.

In addition, the provision of the distortion preventing member 20 in the terminal accommodating cavity 12 of the connector housing 10 can surely prevent distortion of the pin terminal 1 and can correct easily the slanting insertion direction of the pin terminal 1. The conventional receptacle terminal 30 itself requires no modification thereof, because the distortion preventing member 20 is defined not to interfere with the receptacle terminal 30. That is, the conventional receptacle terminal 30 will be advantageously applied in the connector housing 10.

Moreover, the extended wall 23 having the length L (see FIG. 1), which extends from the rising wall 21 and does not interfere with the resilient contact tongue 34 of the receptacle terminal 30, requests the pin terminal 1 to advance more than the length L within the electrical connection portion 32 of the receptacle terminal 30 for make contact with the resilient contact tongue 34. In other words, the distortion preventing member 20 having the extended wall 23 of the length L within the terminal accommodating cavity 12 acts in the same way as another receptacle terminal 30 that will be positioned to be spaced by the length L from the pin terminal insertion opening 15*b* within the terminal accommodating cavity 12. In relation to the overall length of the pin terminal 1, the length L of the extended wall23 is modified. This eliminates the modification of the receptacle terminal 30 or the connector housing 10 according to the overall length of the pin terminal 1. As a result, the receptacle terminal 30 or the connector housing 10 will be reduced in manufacturing cost thereof.

What is claimed is:

1. An electrical connector comprising:

a connector housing;

at least a terminal accommodating cavity defined in said connector housing for receiving a receptacle terminal of a rectangular hollow beam, said receptacle terminal having an electrical connection portion including a resilient contact tongue;

a pin terminal insertion opening defined in said connector housing; and a distortion preventing member extending from said pin terminal insertion opening in said terminal accommodating cavity, wherein said distortion preventing member is defined to prevent distortion of a pin terminal even when said pin terminal is incorrectly inserted in a slanting direction through said pin terminal insertion opening into said receptacle terminal; said distortion preventing member has a rising wall rising from a bottom wall of said terminal accommodating cavity, said rising wall opposed to said resilient contact tongue, and an extended wall extending from a free end of said rising wall into said terminal accommodating cavity, said extended wall being in no interference relation with said resilient contact tongue, whereby said pin terminal is corrected in its insertion direction by said extended wall and an inner surface of said pin terminal insertion opening when said pin terminal is inserted incorrectly in a slanting direction into said receptacle terminal; and a clearance is provided between each side wall of said terminal accommodating cavity and said distortion preventing member for partially inserting a side wall of said receptacle terminal.

2. The connector recited in claim 1, wherein said distortion preventing member has a rising wall rising from a bottom wall of said terminal accommodating cavity, said rising wall opposed to said resilient contact tongue, and an extended wall extending from a free end of said rising wall into said terminal accommodating cavity, said extended wall being in no interference relation with said resilient contact tongue, whereby said pin terminal is corrected in its insertion direction by said extended wall and said inner surface of said pin terminal insertion opening when said pin terminal is inserted incorrectly in a slanting direction into said receptacle terminal.

3. The connector recited in claim 2, wherein said extended wall is substantially the same as said pin terminal in lateral width.

4. The connector recited in claim 3, wherein said extended wall has a slit positioned in a middle portion thereof, said slit extending in the insertion direction of said pin terminal.

5. The connector recited in claim 2, wherein said extended wall is constructed in such a way that said pin terminal can make contact with said resilient contact tongue in a region of said connector housing which is longitudinally inner from said extended wall in the direction of said connector housing.

6. The connector recited in claim 2, wherein a clearance is provided between each side wall of said terminal accommodating cavity and said distortion preventing member for partially inserting a side wall of said receptacle terminal.

7. The connector recited in claim 2, wherein said receptacle terminal has at least a raised contact defined by partially pushing out a top wall of said receptacle terminal, said raised contact having an elongated length extending in a longitudinal direction of said receptacle terminal.

* * * * *